US008926358B2

(12) United States Patent
Kuo

(10) Patent No.: US 8,926,358 B2
(45) Date of Patent: Jan. 6, 2015

(54) USB CONNECTOR POSITIONING STRUCTURE

(71) Applicant: Adlink Technology Inc., New Taipei (TW)

(72) Inventor: Jen-Chieh Kuo, New Taipei (TW)

(73) Assignee: Adlink Technology Inc., New Taipei (TW)

( * ) Notice: Subject to any disclaimer, the term of this patent is extended or adjusted under 35 U.S.C. 154(b) by 102 days.

(21) Appl. No.: 13/862,959

(22) Filed: Apr. 15, 2013

(65) Prior Publication Data

US 2014/0308838 A1 Oct. 16, 2014

(51) Int. Cl.
*H01R 13/62* (2006.01)
*H01R 13/629* (2006.01)

(52) U.S. Cl.
CPC ..... *H01R 13/629* (2013.01)
USPC ..... 439/369; 439/367

(58) Field of Classification Search
CPC ..... H01R 13/6392; H01R 13/6395; H01R 13/639
USPC ..... 439/347, 369, 367, 373
See application file for complete search history.

(56) References Cited

U.S. PATENT DOCUMENTS

| | | | | |
|---|---|---|---|---|
| 4,652,069 | A * | 3/1987 | Smith | 439/369 |
| 5,575,677 | A * | 11/1996 | Buckner et al. | 439/373 |
| 5,928,023 | A * | 7/1999 | Buckner et al. | 439/373 |
| 6,520,792 | B2 * | 2/2003 | Chen-Chiang et al. | 439/373 |
| 7,374,454 | B1 * | 5/2008 | Wang | 439/536 |
| 7,637,772 | B2 * | 12/2009 | Wang | 439/536 |
| 7,927,126 | B1 * | 4/2011 | Bender | 439/369 |
| 8,613,629 | B2 * | 12/2013 | Gong et al. | 439/371 |

* cited by examiner

*Primary Examiner* — Hae Moon Hyeon
(74) *Attorney, Agent, or Firm* — Muncy, Geissler, Olds & Lowe, P.C.

(57) ABSTRACT

A USB connector positioning structure includes a protective casing affixed to a frame shell of a machine case around a USB connector insertion slot for guiding insertion of a male USB connector through the USB connector insertion slot into a plug hole in a female USB connector at a circuit board inside the machine case, and a positioning holder shell pivotally coupled to the protective casing and biasable between a close horizontal position and an opened vertical position and movable along two horizontal guide slots of the protective casing for holding an inserted male USB connector in connection with the female USB connector in the machine case and protecting the inserted male USB connector against external pressure, and holding screws for locking the protective casing and the inserted gale USB connector in position.

5 Claims, 10 Drawing Sheets

USB CONNECTOR POSITIONING STRUCTURE

BACKGROUND OF THE INVENTION

1. Field of the Invention

The present invention relates to Universal Serial Bus (USB) connector positioning technology and more particularly, to a USB connector positioning structure, which comprises a protective casing mountable at a frame shell of a machine case around a USB connector insertion slot for guiding insertion of a male USB connector through the USB connector insertion slot into a plug hole in a female USB connector at a circuit board inside the machine case, and a positioning holder shell coupled to the protective casing for holding the inserted male USB connector in place, prohibiting the male USB connector from a backward displacement or accidental falling due to an external vibration force, protecting the installed male USB connector against accidental damage, and enhancing the operational stability of the installed male USB connector.

2. Description of the Related Art

Following fast development of computer electronic technology, powerful, high-speed, inexpensive computers, industrial computer servers, embedded systems and related products with large capacity and low profile characteristics have been continuously created. Further, many different interface connectors are widely used in computers and related peripheral devices for data transmission. Among the known interface connectors, USB connectors are mostly invited for the advantage of supporting hot plugging.

Further, with the development of information business technology and cloud technology and popularity of social networking sites, personal, home and industrial computers and embedded systems and smart mobile equipment, people can easily find information on the internet. However, when finding data on the internet, the user's personal data can easily be stolen or broken by a hiker, or computer virus may enter the user's computer system through an attachment to an e-mail. In order to protect user's computer system against hiker or E-mail attached virus, a motherboard or interface circuit board may be equipped with a hardware chip for protecting digital data by means of information encryption and decryption technology. Further, to enhance data security and use convenience, golden key USB connectors are highly invited. By means of plugging or unplugging the golden key, data reading or closing of an encrypted virtual hard disk is automatically performed.

Further, USB connectors are widely used for connection between a computer peripheral apparatus (for example printer, Internet video device, USB key, USB disk, USB cable, memory stick, mobile disk drive, card reader, and etc.) and a computer to expand the function and to assure a high level of data transmission stability.

When connecting a male USB connector, for example, USB disk or USB cable, to a mating female USB connector at a motherboard or interface circuit board, the user must insert the standard A-plug of the male USB connector into the plug hole in the mating female USB connector to force the metal conducting contacts at the tongue plate in the standard A-plug of the male USB connector into contact with respective metal conducting contacts in the mating female USB connector. After insertion of the standard A-plug of the male USB connector into the mating female USB connector, spring leaves of the mating female. USB connector are respectively engaged into respective locating holes at the standard A-plug of the male USB connector to hold the inserted male USB connector in position. However, the limited contact area between the spring leaves of the mating female USB connector and the locating holes at the standard A-plug of the male USB connector is insufficient to keep the inserted male USB connector constantly and accurately in position. Further, the motherboard or interface. circuit board does not provide any support means around the mating female USB connector to support the inserted male USB connector in position. If the male USB connector is vibrated accidentally by an external force, or the user plugs or unplugs an interface card or bus line in the computer system, or the computer system is under an environment of low level of reliability, the inserted male USA connector may be loosened and electrically disconnected from the mating female USB connector, causing damage or losing its function.

SUMMARY OF THE INVENTION

The present invention has been accomplished under the circumstances in view. It is one object of the present invention to provide a USB connector positioning structure, which comprises a protective casing mountable at a frame shell of a machine case around a USB connector insertion slot for guiding insertion of a male USB connector through the USB connector insertion slot into a plug hole in a female USB connector at a circuit board inside the machine case, and a positioning holder shell coupled to the protective casing for holding the inserted male USB connector in place. The protective casing comprises a horizontal top panel, two vertical side panels respectively downwardly extended from two opposite lateral sides of the horizontal top panel and defining with said horizontal top panel a forwardly extending bottom open space having opposing front and rear openings, two sliding guides respectively located in the vertical side panels, and two mounting lugs respectively perpendicularly extended from a rear end of each of the two vertical side panels at right angle in opposite direction for mounting. The positioning holder shell comprises a horizontal bottom panel, two upright side panels respectively located at two opposite lateral sides of the horizontal bottom panel, an upright front panel located at a front side of the horizontal bottom panel and defining with the horizontal bottom panel and the two upright side panels a backwardly extending top open space in match with the forwardly extending bottom open space of the protective casing, two coupling members respectively located at the upright side panels outside the backwardly extending top open space and respectively coupled to the sliding guides to secure the positioning holder shell to the protective casing, allowing the positioning holder shell to be moved forward and backward relative to the protective casing between an open condition and a close position. Thus, the positioning holder shell can prohibit the male USB connector from a backward displacement or accidental falling due to an external vibration force, protects the installed male USB connector against accidental damage, and enhances the operational stability of the installed male USB connector.

Further, each sliding guide of the protective casing comprises a horizontally extending sliding slot cut through one respective vertical side panel of the protective casing; each coupling member of the positioning holder shell comprises a pivot rod slidably coupled to the horizontally extending sliding slot of one respective sliding guide for enabling the positioning holder shell to be biased relative to the protective casing between a horizontal position received in the forwardly extending bottom open space of the protective casing and a vertical position suspended outside the protective casing, and moved horizontally forward and backward relative to the protective casing along the horizontally extending sliding slots of the sliding guide.

Further, the positioning holder shell comprises two screw holes respectively located at the upright side panels at a front side relative to the coupling members, and two holding screws respectively threaded into the screw holes and stoppable against two opposite lateral sides of the inserted male USB connector to lock the positioning holder shell and the inserted male USB connector in position.

DETAILED DESCRIPTION OF THE PREFERRED EMBODIMENT

Figure 1:
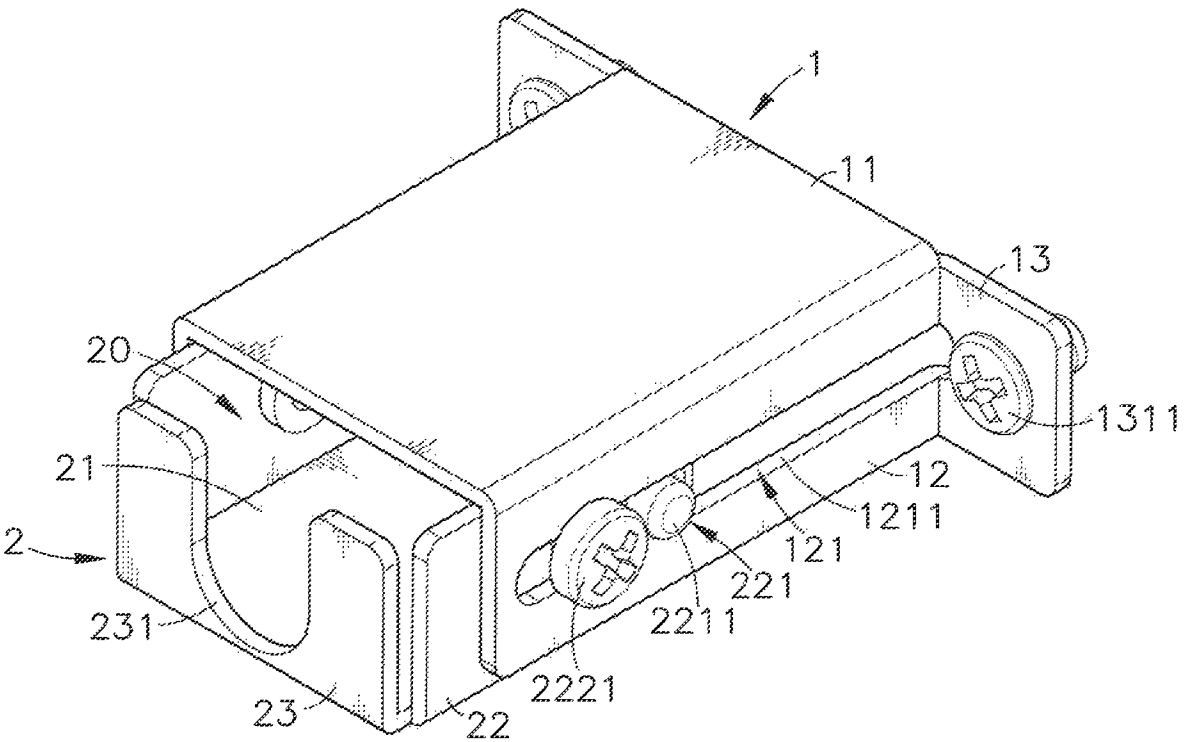
FIG. 1 is an oblique top elevation of a USB connector positioning structure in accordance with the present invention.
Figure 2:
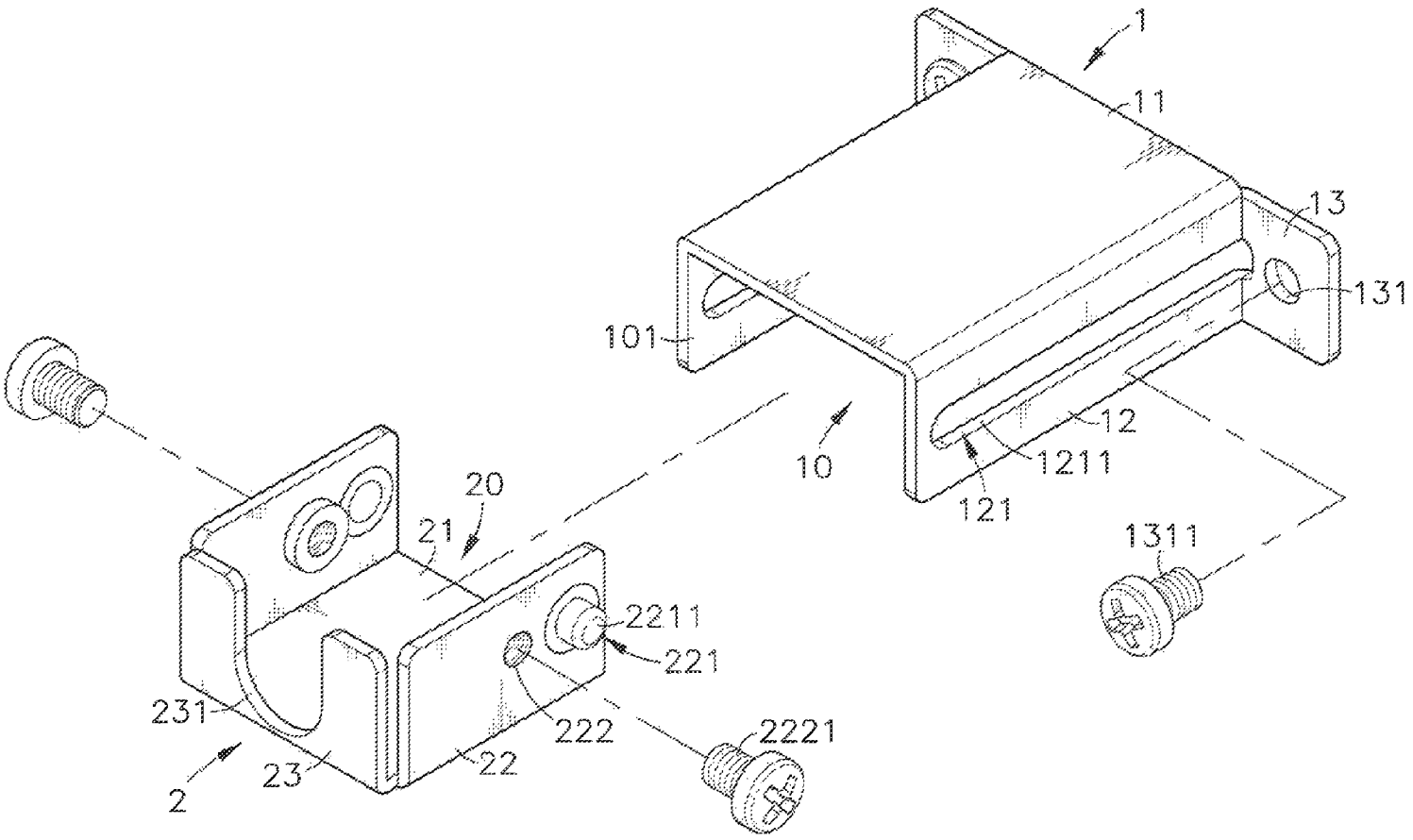
FIG. 2 is an exploded view of the USB connector positioning structure in accordance with the present invention.
Figure 3:
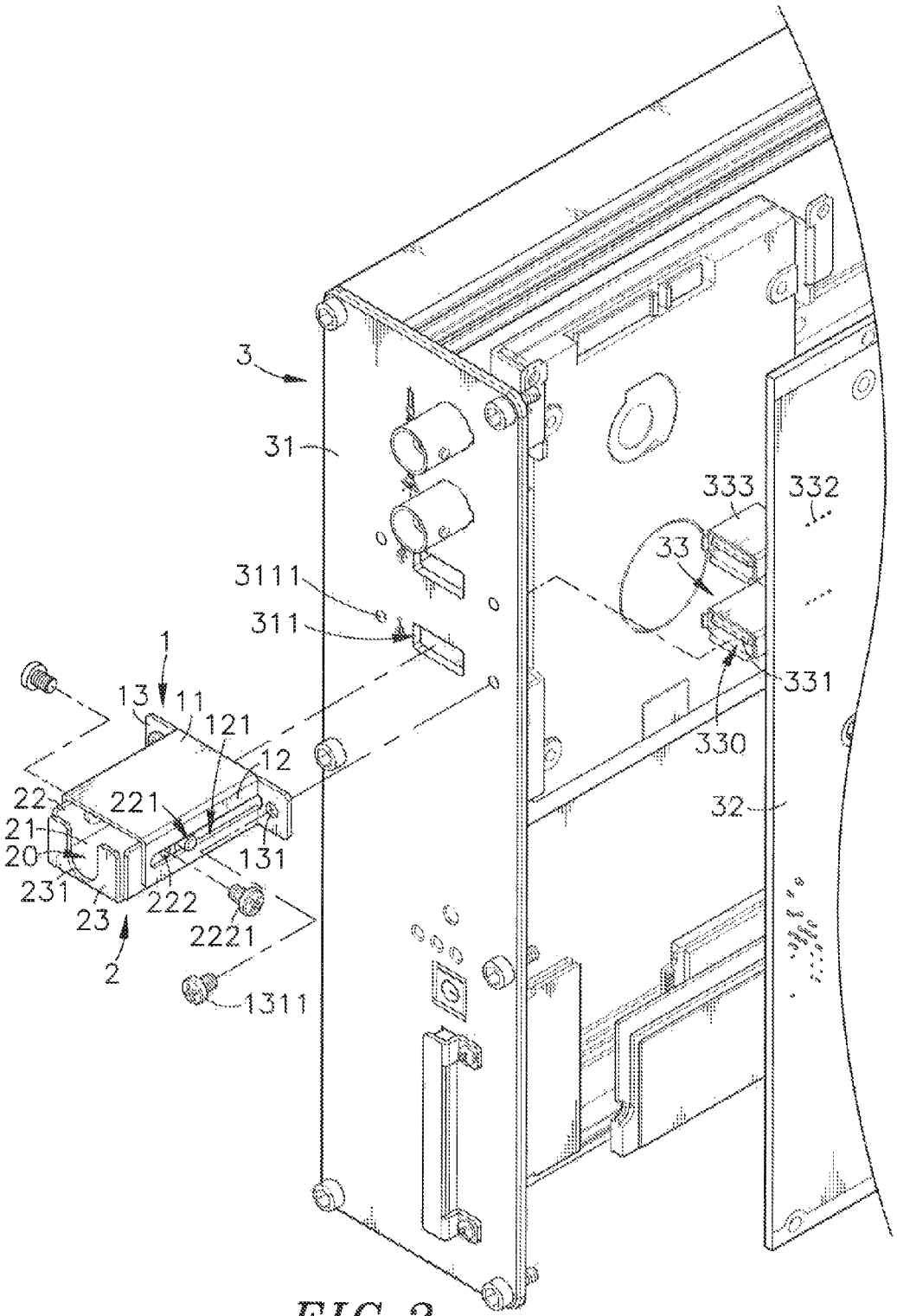
FIG. 3 is an exploded installed vie the USB connector positioning structure in accordance with the present invention.
Figure 4:
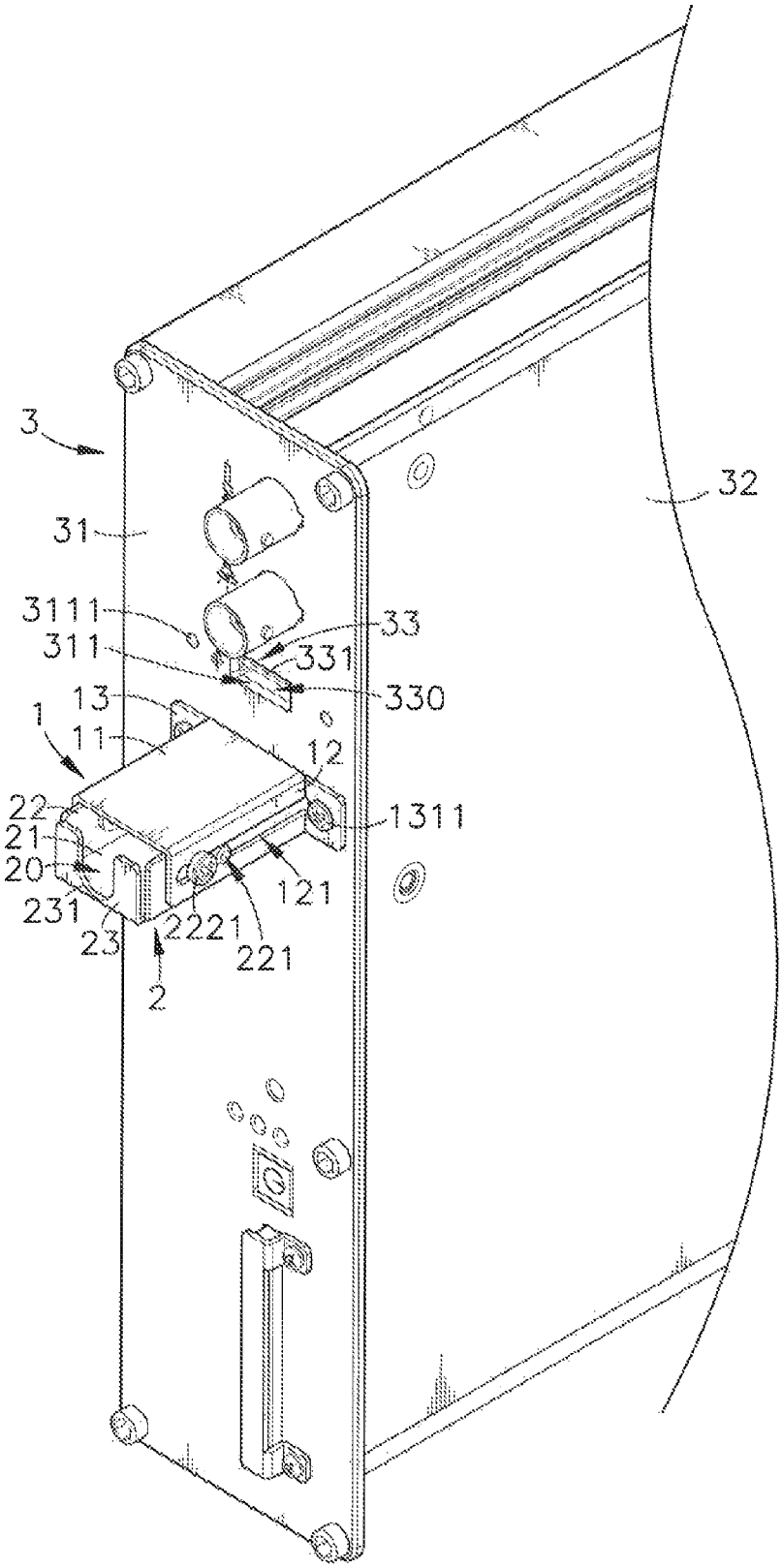
FIG. 4 corresponds to FIG. 3, illustrating the USB connector positioning structure affixed to the frame shell of the machine case.
Figure 5:
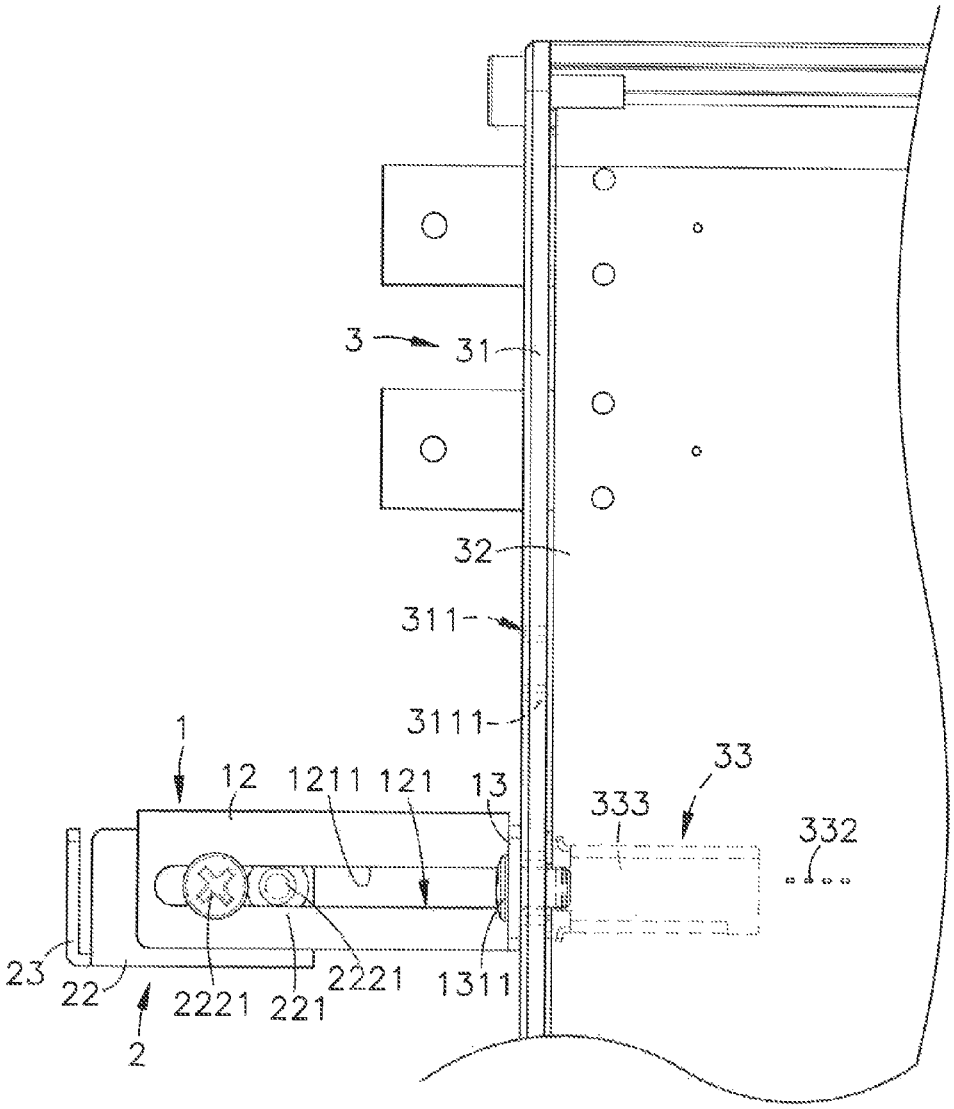
FIG. 5 is a schematic side view of FIG. 5.
Figure 6:
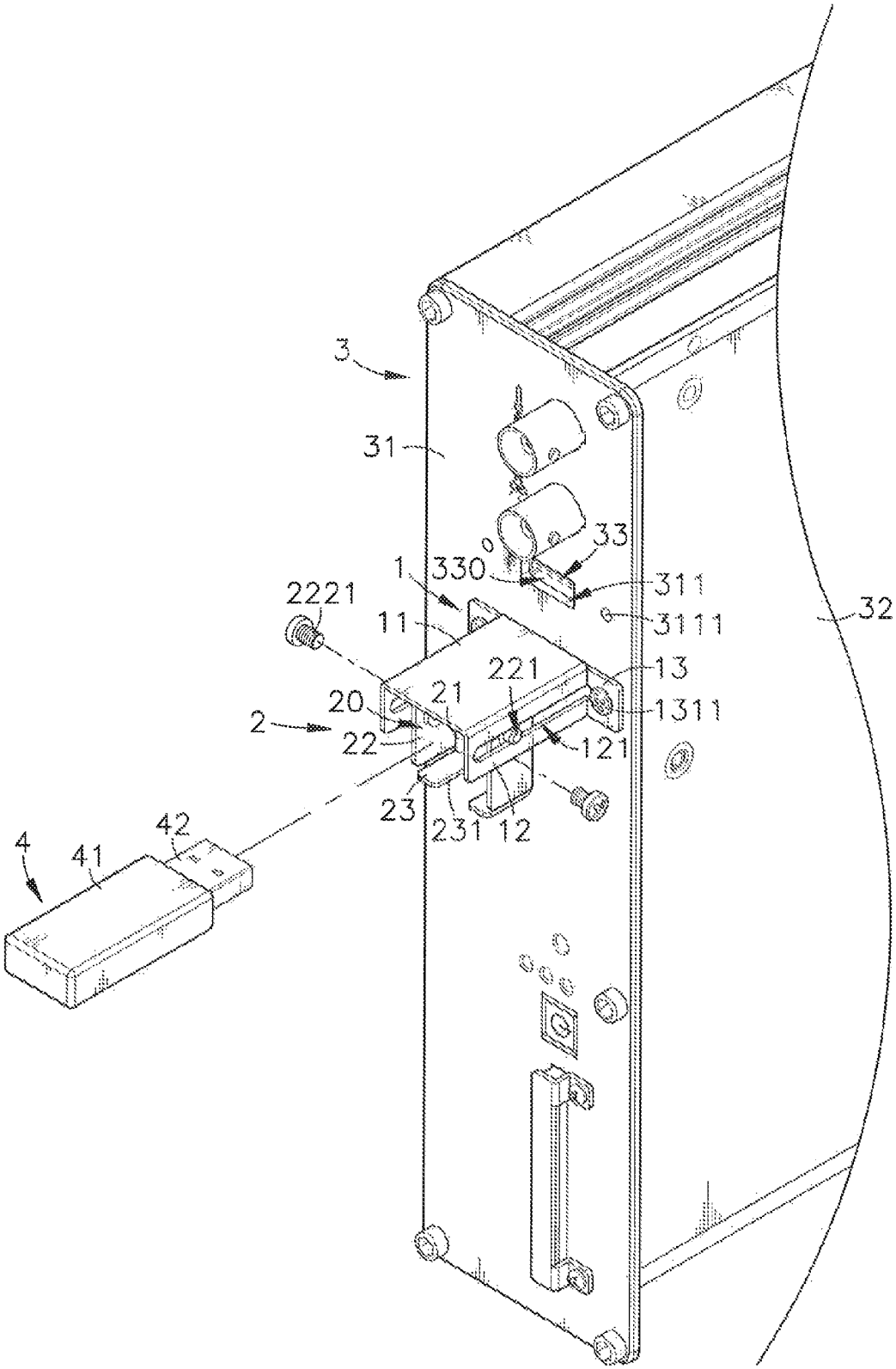
FIG. 6 is a schematic applied view of the present invention, illustrating the positioning holder shell of the USB connector positioning structure opened before insertion of a male USB connector.

Referring to FIGS. 1-5, a USB connector positioning structure in accordance with the present invention is shown. As illustrated, the USB connector positioning structure comprises a protective casing 1, and a positioning holder shell 2.

The protective casing I comprises a horizontal top panel 11, two vertical side panels 12 respectively downwardly extended from two opposite lateral sides of the horizontal top panel 11 and defining with the horizontal top panel 11 a forwardly extending bottom open space 10 having opposing front and rear openings 101, a sliding guide 121, for example, sliding slot 1211 located in each vertical side panel 12, two mounting lugs 13 respectively perpendicularly extended from the rear end of each of the two vertical side panels 12 at right angle in opposite direction, and a mounting through hole 131 located on each mounting lug 13 for the mounting of one respective mounting screw 1311 to affix the protective casing 1 to a machine ease 3.

The positioning holder shell 2 comprises a horizontal bottom panel 21, two upright side panels 22 respectively located at two opposite lateral sides of the horizontal bottom panel 21, an upright front panel 23 located at a front side of the horizontal bottom panel 21 and defining with the horizontal bottom panel 21 and the two upright side panels 22 a backwardly extending top open space 20 in match with the forwardly extending bottom open space 10 of the protective casing 1, a locating opening 231 located on the upright front panel 23, a coupling member 221, for example, pivot rod 2211 located at the outer wall of each upright side panel 22 near the rear side thereof for coupling to the sliding guide 121, i.e., the sliding slot 1211 at one respective vertical side panel 12 of the protective casing 1, and a screw hole 222 located at each upright side panel 22 at a front side relative to the associating coupling member 221, i.e., the associating pivot rod 2211 for the mounting one respective holding member, for example, holding screw 2221.

The USB connector positioning structure is applicable to a machine case 3, for example, the case of a computer system, industrial computer server, embedded system, or any other machine. The machine case 3 comprises a frame shell 31 accommodating therein a circuit board 32. The frame shell 31 comprises a plurality of USB connector insertion slots 311, and a plurality of mounting screw holes 3111 respectively located at two opposite lateral sides of each of the USB connector insertion slots 311. The circuit board 32 comprises a plurality of USB connectors 33. In this embodiment, the USB connectors 33 are female USB connectors, i.e., USB sockets, each comprising a base member 331, a set of conducting terminals 332 positioned in a tongue plate of the base member 331, a metal shell 333 surrounding the base member 331, and a plug hole 330 defined in between the metal shell 333 and the tongue plate of the base member 331.

During installation of the USB connector positioning structure, insert the positioning holder shell 2 through the rear opening 101 into the forwardly extending bottom open space 10 of the protective casing 1 to force the respective pivot rods 2211 (coupling members 221) into the respective sliding slots 1211 (sliding guides 121). At this time, the positioning holder shell 2 is pivotally and slidably coupled to the protective casing 1 and can he moved relative to the protective casing 1 along the respective sliding slots 1211 (sliding guides 121) and biased relative to the protective casing 1 in and out of the forwardly extending bottom open space 10. Thereafter, insert the respective holding screws 2221 through the respective sliding slots 1211 (sliding guides 121) and thread the respective holding screws 2221 into the respective screw holes 222 to secure the positioning holder shell 2 to the inside of the protective casing 1 in horizontal. At this time, the positioning holder shell 2 is received in the forwardly extending bottom open space 10 inside the protective casing 1.

After the protective casing 1 and the positioning holder shell 2 are assembled, attach the two mounting lugs 13 of the protective casing 1 to the frame shell 31 of the machine case 3 around one USB connector insertion slot 311 to keep the mounting through holes 131 of the two mounting lugs 13 in alignment with the respective mounting screw holes 3111, and then fasten respective mounting screws 1311 to the respective mounting through holes 131 and the respective mounting screw holes 3111 to affix the protective easing 1 of the assembled USB connector positioning structure to the machine case 3.

Referring to FIGS, 6, 7 and 8, during application of the present invention, remove the holding screws 2221 from the respective sliding slots 1211 (sliding guides 121) and the respective holding screws 2221 to release the positioning holder shell 2 from the constraint of the holding screws 2221. At this time, subject to coupling between the pivot rods 2211 (coupling members 221) and the respective sliding slots 1211 (sliding guides 121), the positioning holder shell 2 can be moved along the sliding slots 1211 (sliding guides 121) of the protective casing 1 between the dosed front ends of the sliding slots 1211 (sliding guides 121) and the frame shell 31 of the machine case 3 and will not be disconnected from the protective casing 1. Further, subject to the effect of gravity, the positioning holder shell 2 swings from the received horizontal position inside the forwardly extending bottom open space 10 inside the protective casing 1 to a suspended vertical position outside the forwardly extending bottom open space 10 of the protective casing 1. At this time, the forwardly extending bottom open space 10 of the protective casing 1 is kept open.

At this time, the user can insert a male A-plug 42 at a front side of a connector body 41 of a compatible male USB connector (for example, USB disk or male USB flash drive) 4 from the front opening 101 through the forwardly extending bottom open space 10 of the protective casing 1 into the respective USB connector insertion slot 311 of the frame shell 31 of the machine case 3 and then the plug hole 330 of the respective female USB connector 33 into electrical contact with the conducting terminals 332 in the base member 331 of the respective female USB connector 33. After the inserted male USB connector (USB disk or male USB flash drive) 4 is electrically connected to the female USB connector 33, bias the positioning holder shell 2 relative to the protective casing 1 from the suspended vertical position to the received horizontal position inside the forwardly extending bottom open space 10 of the protective casing 1, and then insert the respective holding screws 2221 through the respective sliding slots 1211 (sliding guides 121) and thread the respective holding screws 2221 into the respective screw holes 222 to stop the respective ends of the respective holding screws 2221 against the two opposite lateral sides of the male USB connector (USB disk or male USB flash drive) 4, locking the male USB connector (USB disk or male USB flash drive) 4 and the positioning holder shell 2 to the protective casing 1 in the installed position. At this time, the upright front panel 23 of the positioning holder shell 2 is stopped at the back side of the installed male USB connector (USB disk or male USB flash drive) 4, prohibiting the male USB connector (USB disk or male USB flash drive) 4 from a backward displacement relative to the USB connector positioning structure or accidental falling due to an external vibration force, protecting the installed male USB connector (USB disk or male USB flash drivel 4 against accidental damage, and enhancing operational stability of the installed male USB connector (USB disk or male USB flash drive) 4.

Figure 7:
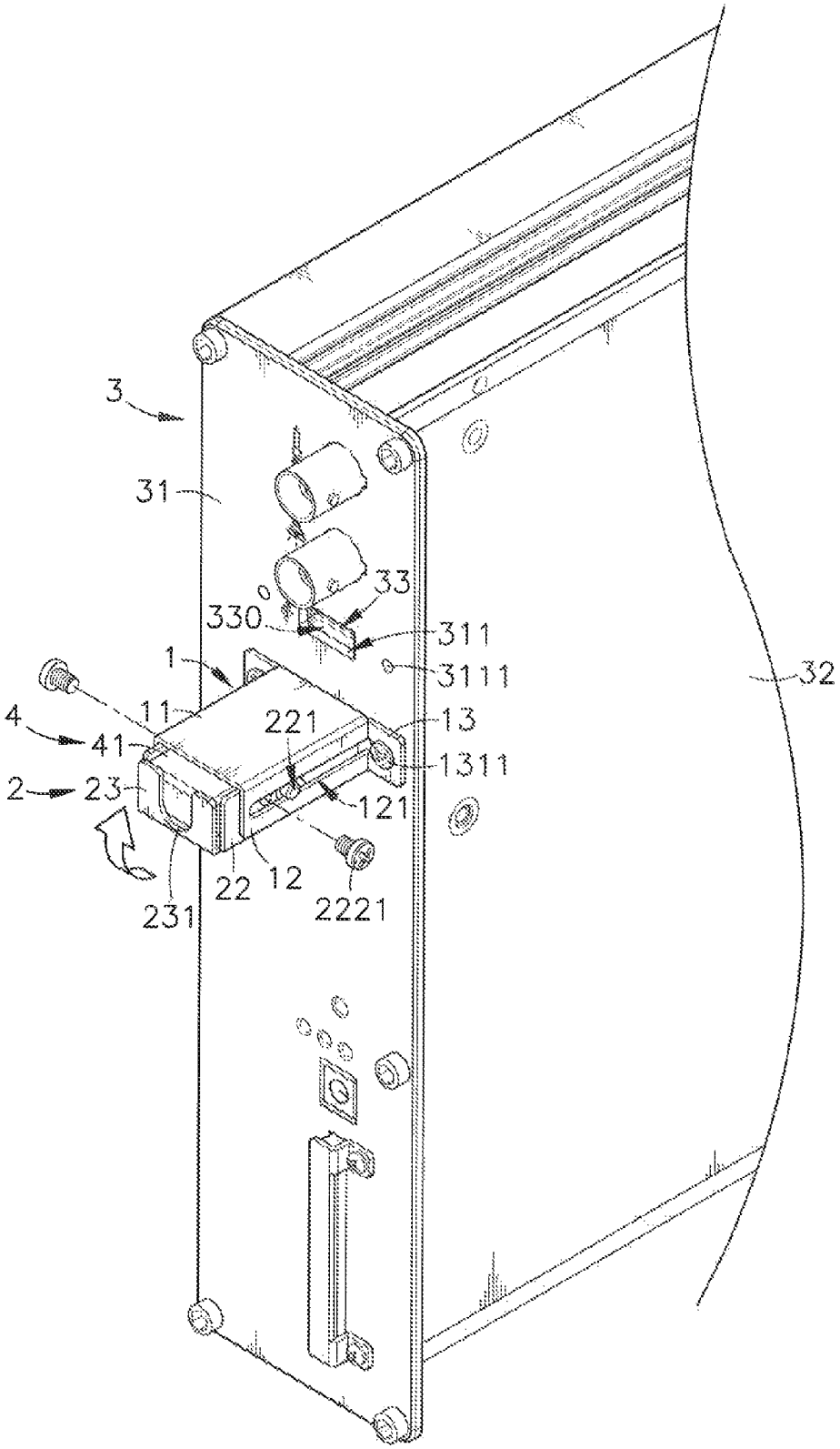
FIG. 7 corresponds to FIG. 6, illustrating the positioning holder shell moved to the close condition after insertion of a male USB connector.
Figure 8:
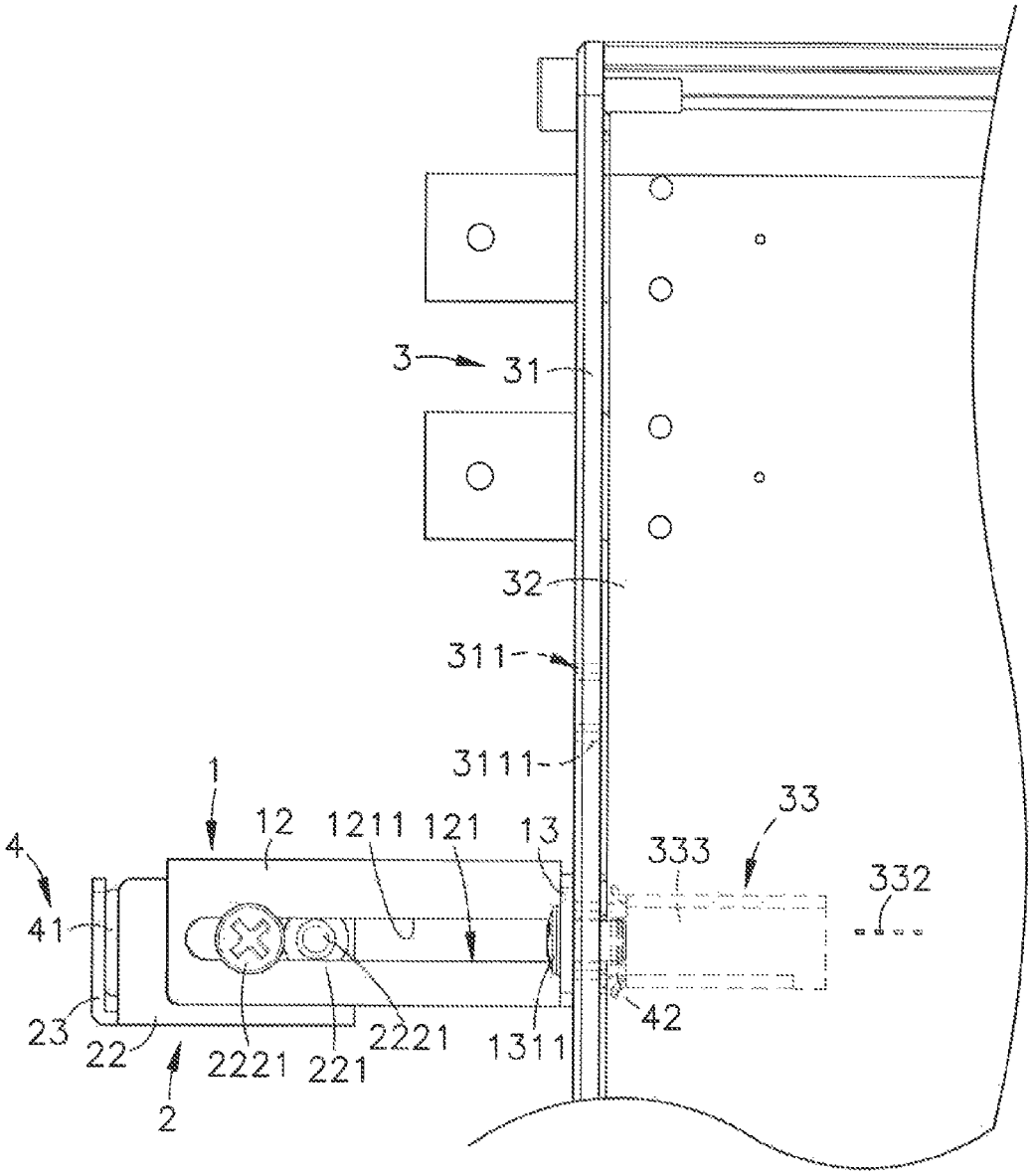
FIG. 8 is a schematic side view corresponding to FIG. 7, illustrating the holding screws installed, the inserted male USB connector and the positioning holder shell locked.
Figure 9:
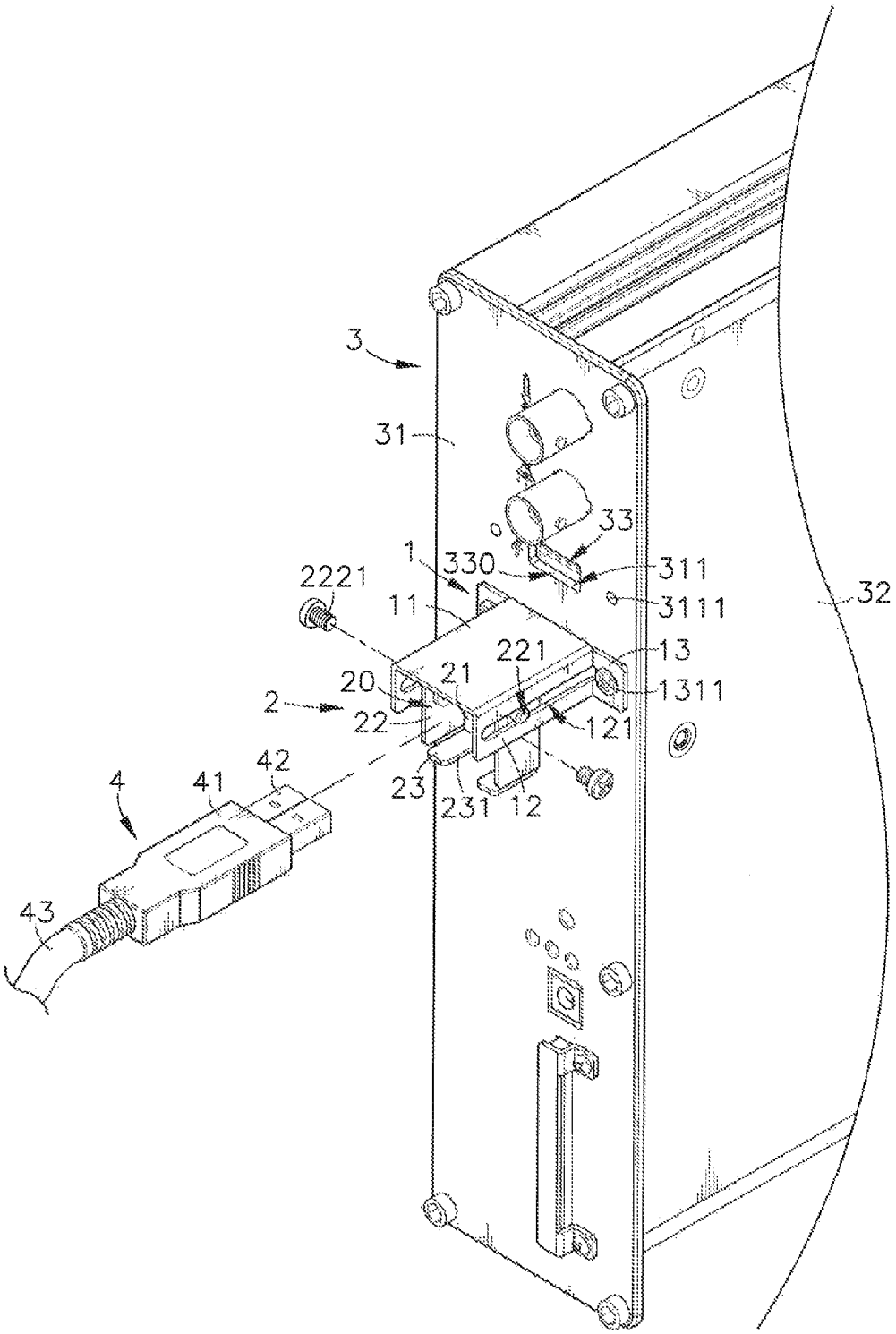
FIG. 9 is a schematic drawing illustrating another application example of the present invention.
Figure 10:
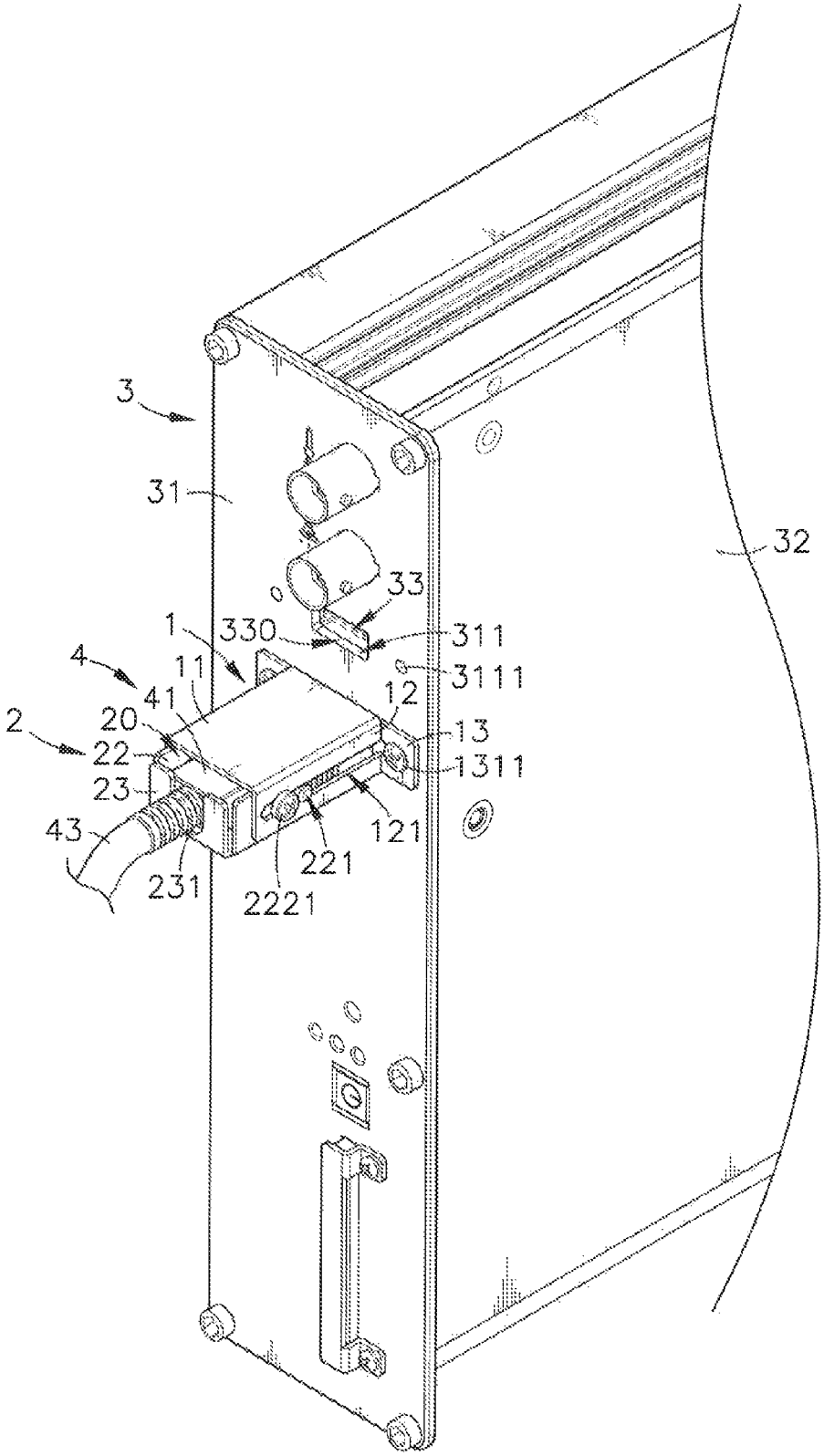
FIG. 10 corresponds to FIG. 9 illustrating the positioning holder shell of the USB connector positioning structure closed after insertion of the male USB connector.

Referring to FIGS. 9 and 10, another application example of the present invention is shown. In the application example shown in FIGS. 7 and 8, the compatible male USB connector 4 is USB disk or male USB flash drive. In this application example, the compatible male USB connector 4 is a USB cable comprising a transmission cable 43 extended from one end of the connector body 41 opposite to the male A-plug 42.

As stated above, during application of the present invention, the user can insert the male A-plug 42 of the male USB connector 4 from the front opening 101 through the forwardly extending bottom open space 10 of the protective casing 1 into the respective USB connector insertion slot 311 of the frame shell 31 of the machine case 3 and then the plug hole 330 of the respective female USB connector 33 into electrical contact with the conducting terminals 332 in the base member 331 of the respective female USB connector 33, and then bias the positioning holder shell 2 relative to the protective casing 1 from the suspended vertical position to a horizontal position and then push the positioning holder shell 2 forwardly to move the pivot rods 2211 (coupling members 221) along the respective sliding slots 1211 (sliding guides 121) to the aforesaid received horizontal position inside the forwardly extending bottom open space 10 of the protective casing 1 where the upright front panel 23 of the positioning holder shell 2 is stopped at the back side of the male USB connector 4, and then insert the respective holding screws 2221 through the respective sliding slots 1211 (sliding guides 121) and thread the respective holding screws 2221 into the respective screw holes 222 to stop the respective ends of the respective holding screws 2221 against the two opposite lateral sides of the male LTSB connector 4, locking the male USB connector 4 and the positioning holder shell 2 to the protective casing 1, Because the positioning holder shell 2 is horizontally movable relative to the protective casing 1, the length of the USB connector positioning structure is adjustable to fit the size of the installed male USB connector (USB disk or USB cable) 4. Therefore, the invention involves an inventive step, and has a wide range of applications.

Although a particular embodiment of the invention has been described in detail for purposes of illustration, various modifications and enhancements may be made without departing from the spirit and scope of the invention. Accordingly, the invention is not to he limited except as by the appended claims.

What the invention claimed is:

1. A USB connector positioning structure, comprising:

a protective casing mountable at a frame shell of a machine case around a USB connector insertion slot for guiding insertion of a male USB connector through said USB connector insertion slot into a plug hole in a female USB connector at a circuit board inside said machine case, said protective casing comprising a horizontal top panel, two vertical side panels respectively downwardly extended from two opposite lateral sides of said horizontal top panel and defining with said horizontal top panel a forwardly extending bottom open space having opposing front and rear openings, two sliding guides respectively located in said vertical side panels, and two mounting lugs respectively perpendicularly extended from a rear end of each of said two vertical side panels at right angle in opposite direction for mounting; and a positioning holder shell coupled to said protective casing and adapted to hold an inserted male USB connector in said protective casing, said positioning holder shell comprising a horizontal bottom panel, two upright side panels respectively located at two opposite lateral sides of said horizontal bottom panel, an upright front panel located at a front side of said horizontal bottom panel and defining with said horizontal bottom panel and said two upright side panels a backwardly extending top open space in match with the forwardly extending bottom open space of said protective casing, two coupling members respectively located at said upright side panels outside said backwardly extending top open space and respectively coupled to said sliding guides to secure said positioning holder shell to said protective casing, allowing said positioning holder shell to be moved forward and backward relative to said protective casing between an open condition and a close position.

2. The USB connector positioning structure as claimed in claim 1, wherein each said sliding guide comprises a horizontally extending sliding slot cut through one respective said vertical side panel of said protective casing; each said coupling member comprises a pivot rod slidably coupled to the horizontally extending sliding slot of one respective said sliding guide for enabling said positioning holder shell to be biased relative to said protective casing between a horizontal position received in said forwardly extending bottom open space of said protective casing and a vertical position suspended outside said protective casing and moved horizontally forward and backward relative to said protective casing along said horizontally extending sliding slots of said sliding guide.

3. The USB connector positioning structure as claimed in claim 2, wherein said positioning holder shell further comprises two screw holes respectively located at said upright side panels at a front side relative to said coupling members, and two holding screws respectively threaded into said screw holes and stoppable against two opposite lateral sides of the inserted male USB connector to lock said positioning holder shell and the inserted male USB connector in position.

4. The USB connector positioning structure as claimed in claim 1, wherein each said mounting lug of said protective casing defines therein a mounting through hole for the mounting of a respective mounting screw to affix said protective casing to said frame shell of said machine case around said USB connector insertion slot.

5. The USB connector positioning structure as claimed in claim 1, wherein said positioning holder shell further comprises a locating opening located on said upright front panel for the passing of a transmission line of the inserted USB male connector.

* * * * *